US006224001B1

(12) United States Patent
Cooke et al.

(10) Patent No.: US 6,224,001 B1
(45) **Date of Patent: *May 1, 2001**

(54) FUEL INJECTOR

(75) Inventors: Michael Peter Cooke, Gillingham; Malcolm David Dick Lambert, Bromley; Trevor Alan Fuller, Maidstone, all of (GB)

(73) Assignee: Lucas Industries Public Limited Company (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/318,991

(22) Filed: May 26, 1999

(30) Foreign Application Priority Data

May 29, 1998 (GB) ..... 9811649

(51) Int. Cl.[7] ..... F02M 61/00

(52) U.S. Cl. ..... 239/533.12; 239/533.2; 239/533.9; 239/533.11; 239/88

(58) Field of Search ..... 239/87, 88, 102.1, 239/102.2, 533.1, 533.02, 533.4, 533.9, 533.11, 533.12

(56) References Cited

U.S. PATENT DOCUMENTS

| | | | | |
|---|---|---|---|---|
| 1,690,893 | * | 11/1928 | Dorner | 239/533.12 |
| 2,096,581 | | 10/1937 | Goldberg . | |
| 4,341,351 | * | 7/1982 | DeLuca | 239/533.12 |
| 4,394,972 | * | 7/1983 | Potter | 239/533.12 |
| 4,613,081 | * | 9/1986 | Bauer | 239/533.12 |
| 4,905,908 | * | 3/1990 | Sczomak | 239/533.12 |
| 4,909,444 | * | 3/1990 | Sczomak | 239/533.12 |
| 5,020,728 | * | 6/1991 | Linder et al. | 239/533.12 |
| 5,094,429 | * | 3/1992 | Dostert | 239/102.2 |
| 5,314,118 | * | 5/1994 | Lembke | 239/102.2 |
| 5,826,801 | * | 10/1998 | Kobayashi et al. | 239/533.4 |
| 5,884,848 | * | 3/1999 | Crofts et al. | 239/533.2 |
| 5,931,390 | * | 8/1999 | Hoffman et al. | 239/562 |

FOREIGN PATENT DOCUMENTS

| | | |
|---|---|---|
| 3431677A | 3/1986 | (DE) . |
| 19548526A | 7/1997 | (DE) . |
| 2339451 | 1/2000 | (GB) . |

* cited by examiner

*Primary Examiner*—David A. Scherbel
(74) *Attorney, Agent, or Firm*—Michael Best & Fredrich LLP

(57) ABSTRACT

An outwardly opening fuel injector comprises a valve needle movable within a bore and engageable with a seating to control the supply of fuel from the bore, the needle being moveable outwardly of the bore to move the needle away from its seating, the needle being biased towards its seating by a spring, the spring engaging a spring abutment arrangement associated with a part of the needle remote from the part thereof engageable with the seating, the spring abutment arrangement further acting to guide movement of the needle.

12 Claims, 4 Drawing Sheets

FUEL INJECTOR

FIELD OF THE INVENTION

This invention relates to a fuel injector for use in supplying fuel to a combustion space of a compression ignition internal combustion engine. In particular, the invention relates to an injector of the outwardly opening type which can be controlled using an electronic control arrangement. Such an injector is suitable for use in, for example, a common rail type fuel system.

SUMMARY OF THE INVENTION

According to the present invention there is provided an outwardly opening fuel injector comprising a valve needle movable within a bore and engageable with a seating to control the supply of fuel from the bore, the needle being moveable outwardly of the bore to move the needle away from its seating, the needle being biased towards its seating by a spring, the spring engaging a spring abutment arrangement associated with a part of the needle remote from the part thereof engageable with the seating, the spring abutment arrangement further acting to guide movement of the needle.

The spring abutment arrangement may comprise a spring abutment member carried by the part of the needle remote from the part thereof engageable with the seating.

The spring abutment member conveniently takes the form of a sleeve which surrounds part of the needle. The sleeve may be in screw threaded engagement with the needle, or alternatively may be secured thereto by welding, using a spring clip, or using any other suitable technique.

The spring abutment member may be arranged to guide movement of the needle by engaging part of the wall of the bore within which the needle is located. Alternatively, the spring abutment member may be arranged to engage the wall of a second bore formed in a separate member, the second bore extending coaxially with the bore within which the needle is located.

The injector conveniently further comprises a piezo-electric actuator arrangement. The piezo-electric actuator arrangement may comprise an actuator arranged to move a piston to control the fluid pressure within a control chamber, part of the needle being exposed to the fluid pressure within the control chamber.

The spring abutment arrangement may, alternatively, comprise a guide region arranged to guide the needle for sliding movement, a fixing region for securing the guide region to the needle and an abutment region arranged to engage the spring, the guide region transmitting the spring load from the abutment region to the fixing region. Two of the regions may, if desired, be integral with one another.

The guide region may be slidable within a bore formed in a sleeve located with a nozzle body.

The invention will further be described, by way of example, with reference to the accompanying drawings, in which:

DETAILED DESCRIPTION OF THE PREFERRED EMBODIMENT

Figure 1:
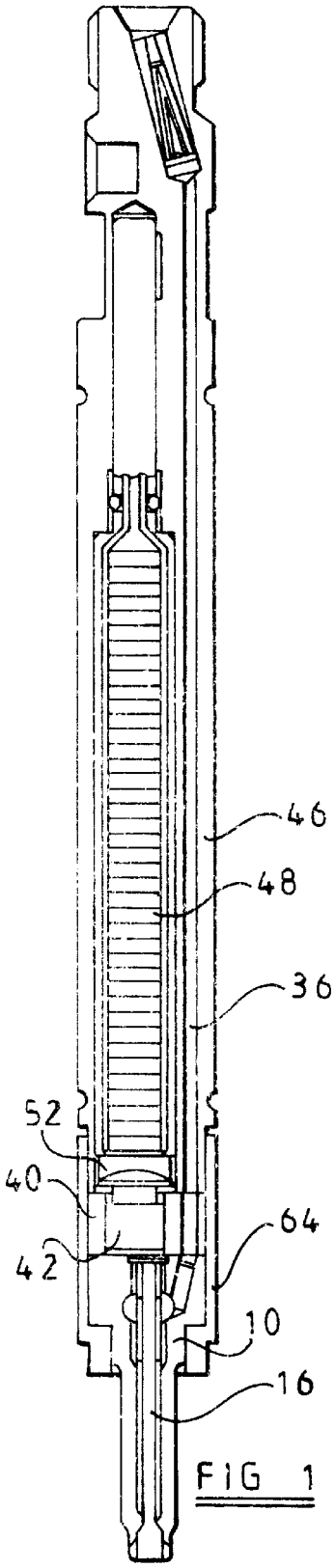
FIG. 1 is a sectional view illustrating an injector in accordance with an embodiment of the invention.
Figure 2:
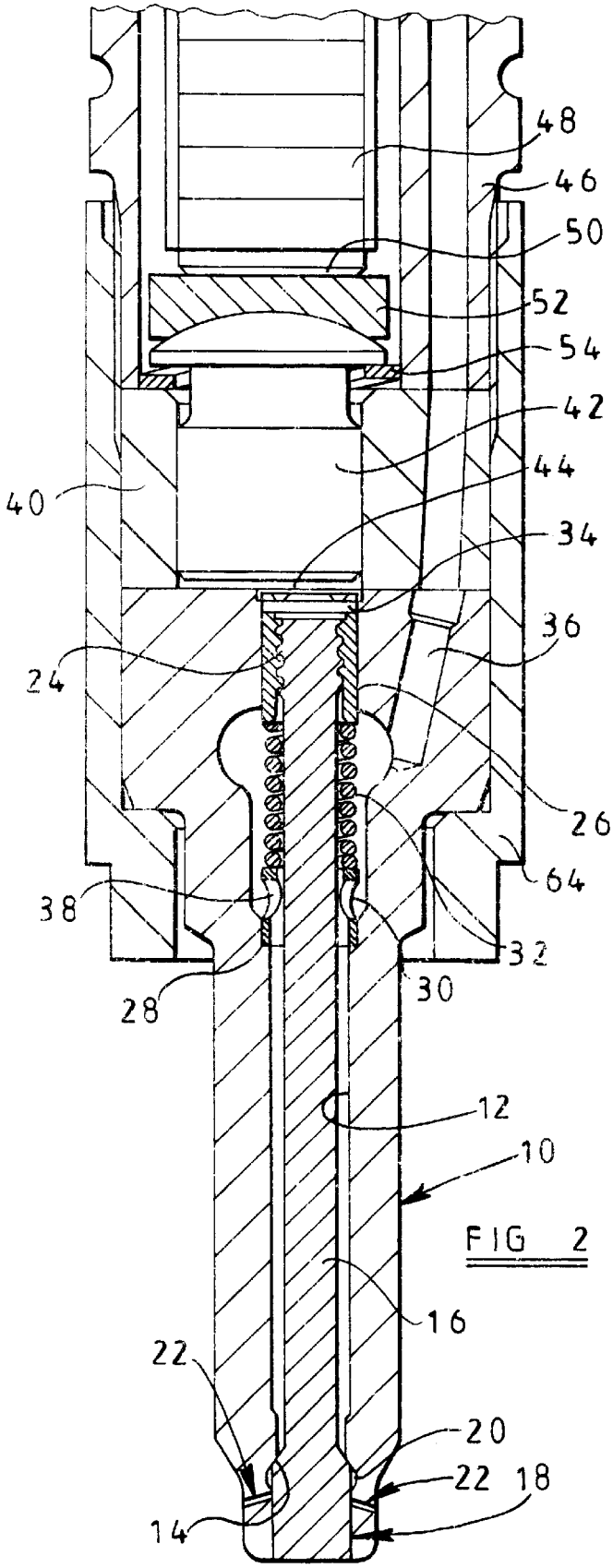
FIG. 2 is an enlargement of part of FIG. 1.

The injector illustrated in FIGS. 1 and 2 comprises a nozzle body 10 having a through bore 12 formed therein. The bore 12 is shaped, adjacent its lower end, to define a seating 14. A valve needle 16 is located within the bore 12, the needle 16 including, at its lower end, a region 18 of enlarged diameter which is engageable with the seating 14 to control communication between a part of the bore 12 upstream of the seating 14 and a chamber 20 defined between part of the bore 12 downstream of the seating 14 and a part of the enlarged diameter region 18 of the needle 16. A plurality of outlet openings 22 are provided in the nozzle body 10 and arranged such that, as the needle 16 moves downwardly away from the seating 14, the openings 22 come into communication with the chamber 20 to permit delivery of fuel through the openings 22.

The upper end of the needle 16 is provided with a screw thread formation 24 which engages a corresponding formation provided upon the interior of a spring abutment arrangement in the form of a spring abutment member 26. The spring abutment member 26 takes the form of a cylindrical sleeve of outer diameter slightly smaller than the diameter of the adjacent part of the bore 12. It will be appreciated that the engagement of the spring abutment member 26 with the wall of the bore 12, and the engagement of the region 18 of the needle 16 with the lower end of the bore 12 guides the needle 16 for movement along the axis of the bore 12.

The bore 12 defines a step 28 with which a second spring abutment member 30 engages. A compression spring 32 is located between the spring abutment member 26 and the second spring abutment member 32 to bias the valve needle 16 in an upward direction, in the orientation illustrated, the bias the region 18 of the needle 16 into engagement with the seating 14. In order to allow the use of a spring of relatively small diameter but constructed of relatively large diameter wire, the screw thread formation 24 is conveniently of generous root radius and of a suitable pitch to allow the spring 32 to pass the screw thread formation 24 by rotating the spring 32 relative to the needle 16, the spring abutment member 26 being secured to the needle 16 after the spring 32 has been located upon the needle 16. Such a screw thread formation further has the advantage that stress concentrations are reduced. It has been found that the use of a small, close fitting thread can form a reasonably good seal due to the long flow path for escaping fluid.

The spring abutment member 26 is conveniently secured to the needle 16 to avoid undesirable relative rotation therebetween, in use, by inserting a pin 34 though openings provided in the spring abutment member 26, the pin 34 extending within a groove or other formation formed in the upper end surface of the needle 16. Alternatively, the pin may engage within castellation like formations provided in the spring abutment member. As further alternatives, a conventional lock nut, lock screw or other thread locking technique may be used.

As illustrated in FIGS. 1 and 2, the bore 12 communicates with a supply passage 36 through which fuel is supplied to the bore 12 from a suitable source of fuel under pressure, in use, for example the common rail of a common rail fuel supply system which is charged with fuel at a high pressure by an appropriate fuel pump. In order to ensure that the second spring abutment 30 does not restrict the flow of fuel towards the seating 14, in use, openings 38 are provided in the second spring abutment member 30.

The face of the nozzle body 10 remote from the end thereof including the seating 14 abuts a piston housing 40 which includes a drilling forming part of the supply passage 36, and a through bore within which a piston member 42 is slidable. The through bore, piston member 42, the adjacent face of the nozzle body 10 and part of the bore 12 together define a control chamber 44. Clearly, the upper end faces of the valve needle 16 and the spring abutment member 26 are exposed to the fluid pressure within the control chamber 44, thus the fluid pressure within the control chamber 44 applies a force to the needle 16 which acts against the action of the spring 32 and the action of the fluid pressure within the nozzle body 10.

The piston housing 40 engages a nozzle holder 46 within which a piezo-electric actuator 48 in the form of a stack of piezo ceramic material is located. The lower end of the actuator 48 engages an anvil 50 which, in turn, engages a slip plate 52. The slip plate 52 engages the upper end of the piston member 42. The slip plate 52 and the adjacent end of the piston member 42 are shaped to compensate for slight misalignment between the axis of the actuator 48 and that of the piston member 42. A spring 54 is engaged between the piston member 42 and the upper surface of the piston housing 40 to bias the piston member 42 towards the actuator 48. The spring 54 takes the form of a wave spring, but it will be appreciated that other types of spring, for example a disc spring or a helical compression spring, could be used.

The nozzle body 10 and piston housing 40 are secured to the nozzle holder 46 by a cap nut 64.

In use, fuel under pressure is supplied through the supply passage 36 to the bore 12. The diameter of the seating 14 and that of the spring abutment member 26, and the force applied to the needle 16, are chosen to ensure that the application of fuel under pressure to the bore 12 does not cause movement of the needle 16 away from the seating 14 at this time. It will be appreciated that the force applied by the spring may be reduced compared with a conventional arrangement as the diameter of the spring abutment member can be relatively large.

A small amount of leakage of fuel between the bore 12 and the spring abutment member 26 occurs, thus fuel is supplied at a low rate to the control chamber 44. Leakage also occurs at a controlled rate between the piston member 42 and the through bore provided in the piston housing 40, permitting fuel to escape from the control chamber 44 to a low pressure drain reservoir, for example the fuel tank. The fuel pressure within the control chamber 44 is therefore relatively low. An optional radial seal, such as an 'O' ring, may be provided between the slip plate 52 and the bore of the nozzle holder 46. This would substantially eliminate the flow of fuel from the control chamber 44 to the low pressure drain reservoir.

When injection is to commence, the actuator is energised to extend in length resulting in movement of the piston member 42 against the action of the spring 54. Such movement pressurizes the fuel within the control chamber 44 thus increasing the downward force applied to the needle 16, and a point will be reached beyond which the needle 16 is able to move in a downward direction, outward of the bore 12, to permit fuel to flow to the chamber 20 and through one or more of the openings 22. The rate at which fuel can escape from the control chamber 44 to the low pressure drain reservoir is chosen to be at a sufficiently low level that the pressure within the control chamber 44 remains high throughout the desired injection period.

The rate at which fuel is delivered is dependent upon the number of openings 22 which are brought into communication with the chamber 20 by the movement of the needle 16. The distance through which the needle 16 moves depends upon the magnitude of the extension of the actuator 48. Clearly, therefore, the rate of injection can be controlled by appropriate control of the extension of the actuator 48.

In order to terminate injection, the actuator 48 is deenergised and returns to substantially its original length. As a result, the piston member 42 moves under the action of the spring 54, reducing the fluid pressure within the control chamber 44 thus reducing the magnitude of the downward force applied to the needle 16, and as a result the needle 16 is able to return into engagement with the seating 14 under the action of the spring 32.

In the event that the actuator fails during injection, the leakage of fuel from the control chamber 44 to the low pressure drain will eventually cause the fuel pressure within the control chamber 44 to fall to a sufficiently low level to terminate injection, thus the injector is fail-safe. The leakage of fuel from the bore 12 to the control chamber 44, in use, compensates for gradual changes in the length of the actuator 48, for example resulting from temperature changes.

Figure 3:
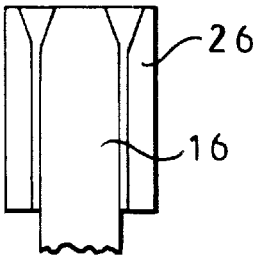
FIGS. 3 and 4 illustrate modifications to the embodiment illustrated in FIGS. 1 and 2.
Figure 4:
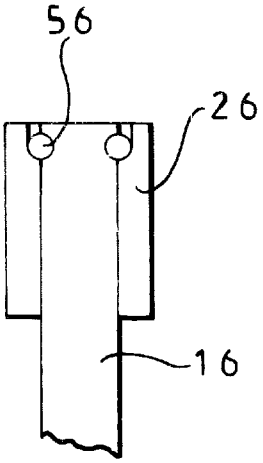

FIG. 3 illustrates a modification in which the spring abutment member 26 is secured to the upper end of the needle 16 by welding after appropriate location of the spring 32 rather than using a screw thread formation, and FIG. 4 illustrates an arrangement in which the spring abutment member 26 is secured in position using a spring clip 56. In both of these arrangements, the presence of fuel under pressure between the needle 16 and the spring abutment member 26 may expand the spring abutment member 26 to compensate for dilation of the bore 12, thus reducing leakage of fuel from the bore 12.

Figure 5:
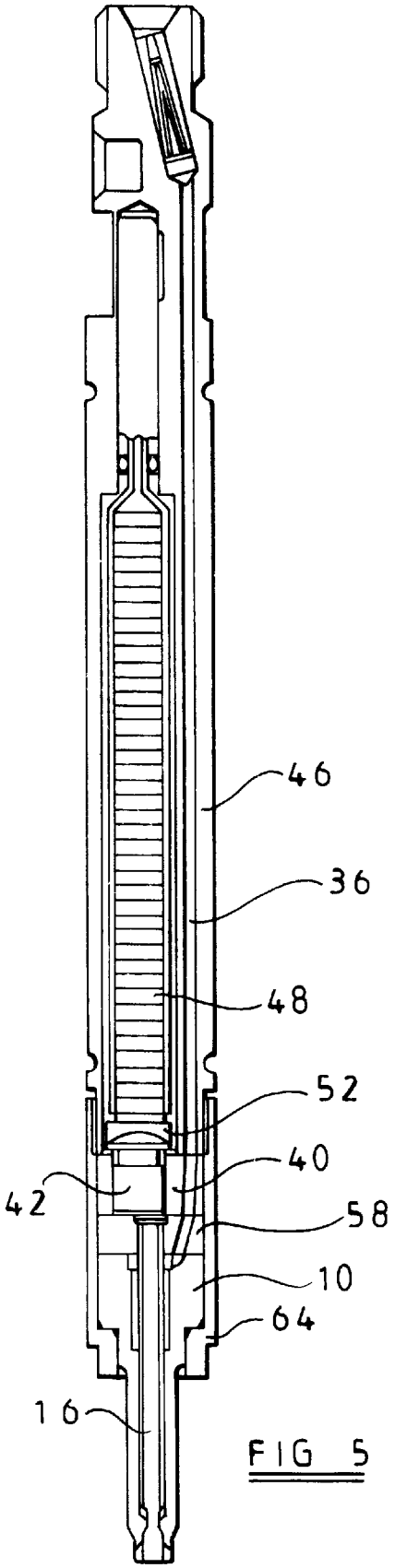
FIGS. 5 and 6 are views similar to FIGS. 1 and 2 illustrating an alternative embodiment.
Figure 6:
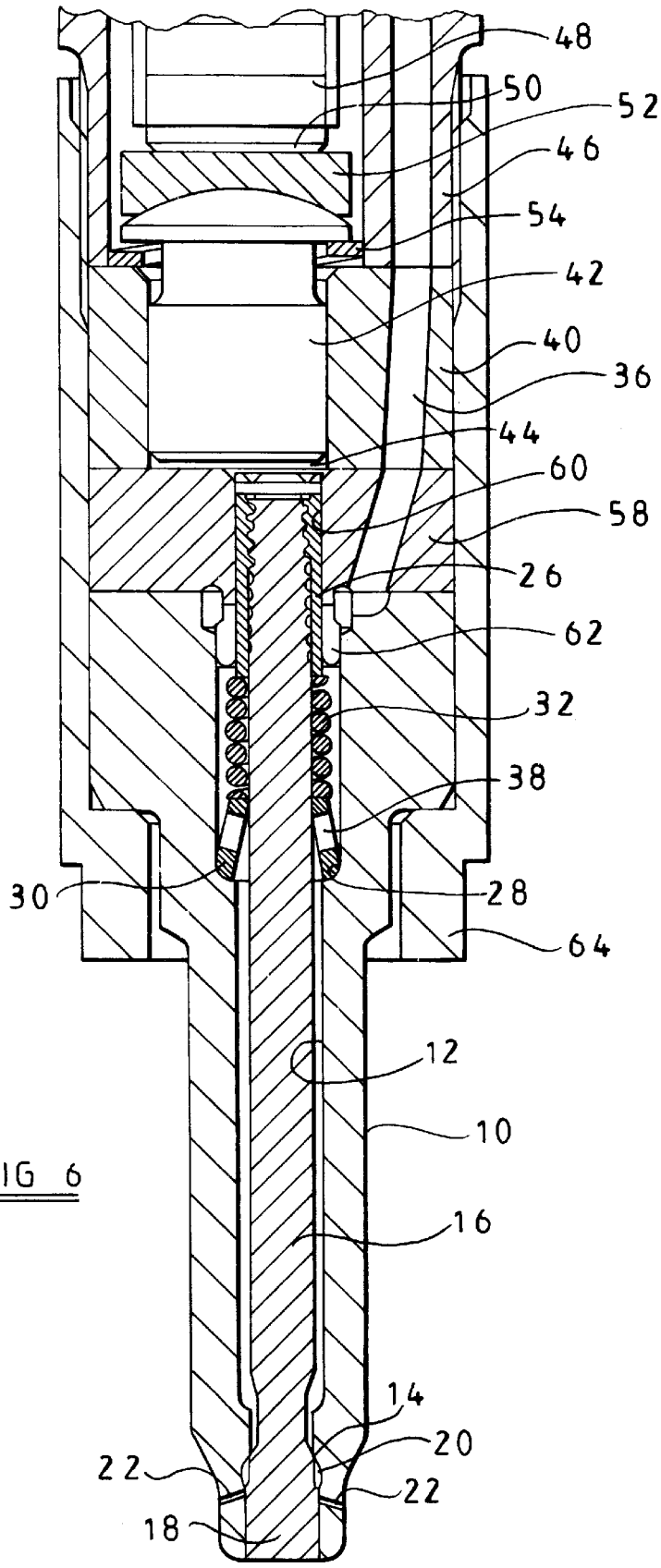

The embodiment illustrated in FIGS. 5 and 6 differs from that described hereinbefore in that a distance piece 58 is located between the nozzle body 10 and the piston housing 40, thus allowing a spring of relatively large diameter to be used. The spring abutment member 26 engages the wall of a second bore 60 extending through the distance piece 58 in order guide movement of the needle 16. Clearly, in order to ensure that the needle 16 is properly guided, the second bore 60 must be coaxial with the bore 12 of the nozzle body 10, and this is achieved by a plurality of fingers 62 which are integral with the distance piece 58, the fingers 62 defining the lower end of the bore 60. The fingers 62 locate, in use, within the upper end of the bore 12 to ensure that the bore 12 is coaxial with the second bore 60. The fingers 62 further define a plurality of flow paths along which fuel flows, in use, from the supply passage 36 to the bore 12.

Operation of the embodiment of FIGS. 5 and 6 is as described hereinbefore with reference to FIGS. 1 and 2, and so will not be described in detail.

It will be appreciated that the embodiment of FIGS. 5 and 6 may be modified using the modifications illustrated in FIGS. 3 and 4.

Figure 7:
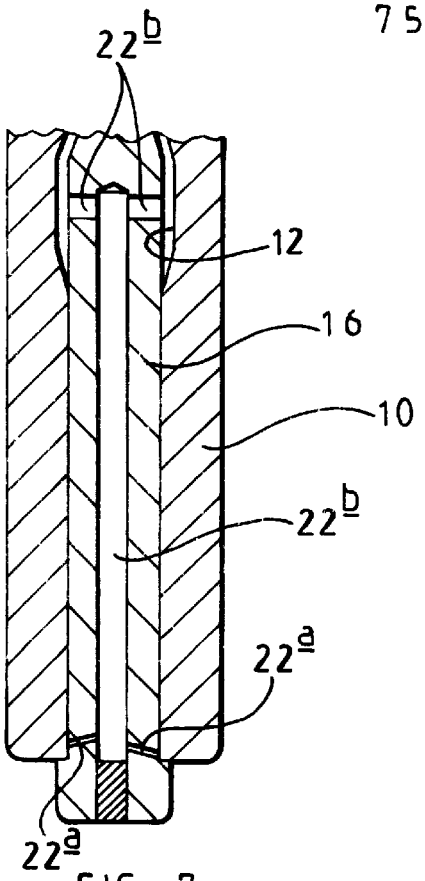
FIG. 7 illustrates a modification to the arrangements of FIGS. 1 to 6.

FIG. 7 illustrates a modification which can be incorporated into any of the embodiments described hereinbefore. In the modification of FIG. 7, the lower end of the needle 16 protrudes from the bore 12, the lower end of the needle 16 being of increased diameter and being engageable with a seating defined around a lower end of the bore 12. The needle 16 is provided with a plurality of outlet openings 22*a* which are positioned in axially spaced locations such that the number of openings 22*a* through which fuel can be delivered at any instant is controlled by controlling the position of the needle 16. The openings 22*a* communicate with the interior of the bore 12 through drillings 22*b* provided in the needle 16.

Figure 8:
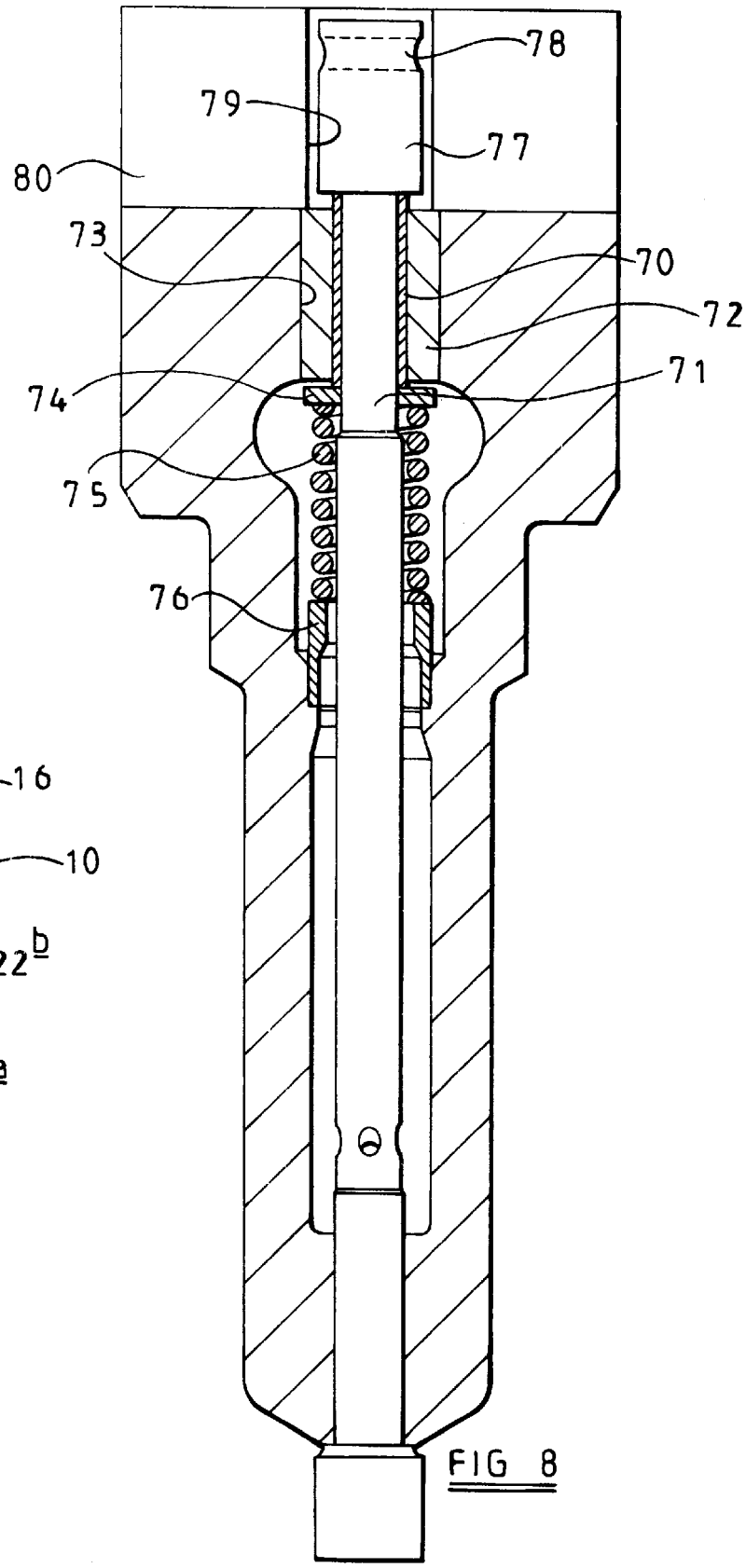
FIG. 8 is a sectional view illustrating a further alternative embodiment.

FIG. 8 illustrates a fuel injector which, in many respects, is similar to or identical to the arrangements described hereinbefore, and only the important distinctions between the arrangement of FIG. 8 and those described hereinbefore will be described.

In the arrangements described hereinbefore, the spring abutment arrangement comprises a sleeve which is screw-threaded upon an end region of the needle. In the arrangement of FIG. 8, the spring abutment arrangement comprises a guide region in the form of a sleeve 70 which surrounds part of a needle 71. The diameter of the sleeve 70 and the adjacent part of the needle 71 is such as to ensure that fuel is only able to escape therebetween at a restricted rate. The sleeve 70 is slidable within a bore formed in a hollow cylindrical member 72 which is received within an upper part of the bore 73 within which the needle 71 is received and moveable. The sleeve 70 and member 72 are a sufficiently good fit that the sleeve 70 is able to slide within the bore of the member 72, but leakage therebetween is restricted to a very low rate.

The lower end of the sleeve 70, in the orientation illustrated, abuts an annular spring abutment member 74 which engages the upper end of a spring 75, the other end of which engages a spring abutment member 76 located against a step formed in the bore 73. The upper end of the sleeve 70 abuts a fixing member in the form of a nut 77 which is in screw-threaded engagement with the upper end region of the needle 71. The nut 77 is conveniently provided with a formation 78 permitting the introduction of a fixing pin which cooperates with both the nut 77 and the needle 71 to secure the nut 77 against rotation relative to the needle 71. If desired, the pin and the formation 78 may be omitted, and instead the nut 77 secured against rotation relative to the needle 71 by means of welding, using a spring clip or any other suitable technique.

As illustrated in FIG. 8, the nut 77 is received within a bore 79 formed in a distance piece 80, the bore 79 defining a chamber which forms part of a control chamber, the fuel pressure within which is controlled by means of an actuator arrangement, for example of the type illustrated in FIGS. 2 and 6. The bore 79 is of reduced diameter compared to the part of the bore 73 within which the member 72 is located. It will be appreciated, therefore, that the lower surface of the distance piece 80 adjacent the bore 79 defines a step against which the member 72 is engageable.

In use, fuel under high pressure is supplied to the bore 73 through appropriate passages (not shown). It will be appreciated that the fuel pressure within the bore 73 is high, applying a relatively high magnitude upwardly directed force, in the orientation illustrated, to the member 72, urging the member 72 into engagement with the step. The engagement between the member 72 and the step defined by the distance piece 80 is sufficient to form a seal between the member 72 and the distance piece 80. As the member 72 and the sleeve 70 together form a substantially fluid tight seal, and the sleeve 70 and needle 71 together form a substantially fluid tight seal, it will be appreciated, therefore, that fuel is only able to flow from the bore 73 to the bore 79 at a very restricted rate.

The dimensions of the needle 71 are such that the application of fuel under pressure to the bore 73 applies an upwardly directed force to the needle 71. This force results from the diameter of the sleeve 70 being greater than the diameter of the lower end of the needle 71 where it is guided for sliding movement in the bore 73. The action of the spring 75 serves to assist the action of the fuel under pressure in urging the needle in an upward direction, the action of the spring 75, the spring load being applied to the needle 71 through the abutment member 74, sleeve 70 and nut 77. The action of the fuel under pressure and the spring 75 is sufficient to ensure that the needle 71 is held in the position illustrated in which outlet openings similar to the openings 22*a* illustrated in FIG. 7 are obscured by the lower end of the bore 73. Injection of fuel is therefore not taking place.

When fuel injection is to occur, the actuator is energized to increase the fuel pressure within the chamber defined, in part, by the bore 79, thus applying a downwardly directed force to the needle 71. A point will be reached beyond which the magnitude of the downwardly directed force will be sufficient to cause the needle 71 to move against the action of the spring 75 and the fuel under pressure within the bore 73 to a position in which fuel injection can occur. Fuel injection is terminated by relieving the fuel pressure within the control chamber defined, in part, by the bore 79, the needle 71 returning to the position illustrated under the action of the spring 75 and the fuel pressure within the bore 73.

It will be appreciated that, if desired, the sleeve 70 may be formed integrally with either the spring abutment member 74 or the nut 77. It will further be appreciated that as the member 72 forms a substantially fluid tight seal with the distance piece 80, the fit of the member 72 within the bore 73 need not be a sealing fit, and the member 72 can adopt a position in which the needle 71 is held substantially co-axially with the bore 73, compensating for any slight manufacturing inaccuracies.

As the diameter of the member 72 is immaterial for the purposes of controlling the operation of the injector, unlike the arrangements illustrated in FIGS. 1 to 4, it will be appreciated that the diameter of the member 72 can be chosen to ensure that the bore 73 is of diameter sufficient to enable the spring 75 to be of a desired diameter and rate. The operation of the injector can therefore be optimised.

What is claimed is:

1. An outwardly opening fuel injector comprising a valve needle movable within a bore and engageable with a seating to control the supply of fuel from the bore, the needle being moveable outwardly of the bore to move the needle away from its seating, the needle being biased towards its seating by a spring, the spring engaging a spring abutment arrangement associated with a part of the needle remote from the part thereof engageable with the seating, the spring abutment arrangement is in sealing contact with the bore to restrict flow and further acting to guide movement of the needle, and a fuel supply passage in communication with the bore between the spring abutment arrangement and the seating.

2. An injector as claimed in claim 1, wherein the spring abutment arrangement comprises a spring abutment member carried by the needle.

3. An injector as claimed in claim 2, wherein the spring abutment member comprises a sleeve which surrounds part of the needle.

4. An injector as claimed in claim 3, wherein the sleeve is in screw-threaded engagement with the needle.

5. An injector as claimed in claim 2, wherein the spring abutment member is in sliding engagement with the wall of the bore.

6. An injector as claimed in claim 2, wherein the spring abutment member is in sliding engagement with the wall of a second bore formed in a separate member located such that the second bore extends generally coaxially with the bore with which the needle is located.

7. An injector as claimed in claim 1, wherein the spring abutment arrangement comprises a guide region moveable with the needle and in sliding engagement with a wall of a bore to guide the needle for movement.

8. An injector as claimed in claim 7, wherein the bore is formed in a separate member located such that the bore of the separate member extends generally coaxially with the bore within which the needle is slidable.

9. An injector as claimed in claim 7, wherein the spring abutment arrangement further comprises a spring abutment region and a fixing region for securing the guide region to the needle.

10. An injector as claimed in claim 9, wherein two of the guide regions, the spring abutment region and the fixing region are formed integrally with one another.

11. An injector as claimed in claim 1, further comprising a piezo-electric actuator arrangement.

12. An injector as claimed in claim 11, wherein the piezo-electric actuator arrangement comprises an actuator arranged to move a piston to control the fluid pressure within a control chamber, a surface associated with the needle being exposed to the fluid pressure within the control chamber.

* * * * *